United States Patent [19]

Nakamura et al.

[11] Patent Number: 4,598,831

[45] Date of Patent: Jul. 8, 1986

[54] HEAT-RESISTANT SYNTHETIC RESIN BOTTLE

[75] Inventors: Yoshinori Nakamura; Yoshiki Miyazawa, both of Sakakimachi, Japan

[73] Assignee: Nissei ASB Machine Co., Ltd., Japan

[21] Appl. No.: 664,503

[22] Filed: Oct. 25, 1984

[30] Foreign Application Priority Data

Oct. 31, 1983 [JP] Japan ..... 58-168962[U]

[51] Int. Cl.[4] ..... B65D 1/02; B65D 1/42; B65D 23/00

[52] U.S. Cl. ..... 215/1 C; 220/70

[58] Field of Search ..... 215/1 C, 12 R; 220/69, 220/70

[56] References Cited

U.S. PATENT DOCUMENTS

| | | | |
|---|---|---|---|
| 2,481,015 | 9/1949 | Ingersoll | 220/69 |
| 3,403,804 | 10/1968 | Colombo | 215/1 C X |
| 3,598,270 | 8/1971 | Adomaitis | 215/1 C |
| 3,727,783 | 4/1973 | Carmichael | 215/1 C |
| 3,973,693 | 8/1976 | Brocklehurst | 220/70 X |
| 4,108,324 | 8/1978 | Krishnakumar et al. | 215/1 C |
| 4,134,510 | 1/1979 | Chang | 215/1 C |
| 4,247,012 | 1/1981 | Alberghini | 215/1 C |
| 4,254,882 | 3/1981 | Yoshino | 215/1 C |
| 4,355,728 | 10/1982 | Yoshino et al. | 215/1 C |

FOREIGN PATENT DOCUMENTS

| | | | |
|---|---|---|---|
| 2448481 | 10/1980 | France | 215/1 C |
| 2067160 | 7/1981 | United Kingdom | 215/1 C |

*Primary Examiner*—William Price
*Assistant Examiner*—Sue A. Weaver

[57] ABSTRACT

Here is disclosed a heat-resistant synthetic resin bottle which is biaxially oriented by axially stretching and air blowing an injected or extruded closed-end parison in a blow mold to carry out molding, whereby a bottom wall of the bottle is recessed toward its interior in the form of a dome and an annular peripheral edge for supporting the bottle itself is formed around the bottom wall, characterized in that a top portion of the bottom wall which thickens gradually from the annular peripheral edge to a central portion thereof is recessed upwardly from the underside of the top portion itself in order to thin the top portion, and the bottom wall between the top portion and the peripheral edge is partially outwardly bulged in order to radially form a predetermined number of triangular pyramid-shaped recessed section and bottom lands between said recessed section.

3 Claims, 4 Drawing Figures

HEAT-RESISTANT SYNTHETIC RESIN BOTTLE

BACKGROUND OF THE INVENTION (1) Field of the Invention

The present invention relates to a biaxially oriented heat-resistant bottle, particularly to a bottle having the heat-resistant bottom portion which can be prepared by stretching and blow molding a thermoplastic resin such as polyethylene terephthalate.

(2) Description of the Prior Art

A self-supporting bottle which can be prepared by axially stretching and air blowing a preform of polyethylene terephthalate is more excellent in durability as compared with a bottle made by blowing molding, but if filled with heated contents, the stretched and air blown bottle must be subjected to a heat treatment so that it may not be contracted and deformed by heating at the filling step. This heat treatment is extremely effective to a sufficiently diaxially oriented body portion and bottom peripheral wall of the bottle, but it is impossible to cause even the bottom wall to have a thermal stability. Thus, most of the bottles are short of the thermal stability to induce the heat deformation on their bottom walls.

The heat resistance of this bottom wall is considered to be improved by attaining a sufficient biaxial orientation also on the bottom wall, but it is difficult to biaxially orient sufficiently even the central portion of the bottle which is restricted in draw ratio from the viewpoint of its bottom structure. Even if the biaxial orientation is attained, the bottom wall, which is recessed inwardly for the betterment of its self-supporting character, will be thin and will expand outwardly by an applied load when filled with contents, with the result that the self-supporting ability of the bottle will be lost.

The self-supporting bottom structure which is generally called a champagne bottom is formed into the shape of a dome, as illustratively shown in FIG. 4, by recessing, toward the interior of a bottle body 11, a bottom wall 13 continuous with a peripheral wall 12 which is sufficiently biaxially oriented together with the bottle 11. Supporting the bottle 1 itself is accomplished by an annular peripheral edge 14 formed between the peripheral wall 12 and the bottom wall 13.

In the case of such a bottom structure, when the bottle 1 is molded in a blow mold 15 by axially stretching and air blowing a parison 16, a bottom portion 16*a* of the parison 16 will be brought into contact with a mold bottom 17 earlier than any other portion thereof and will be cooled. Further, the draw ratio of the parison bottom portion will be small due to the structure of the mold bottom portion 17. Therefore, the bottom wall 13 having a dome shape will be thick-wall in its central portion 13*a* as shown in FIG. 4, and the biaxial orientation will be accomplished only in the sufficiently stretched thin annular peripheral edge 14 and a peripheral portion 13*b* adjacent thereto.

In the bottom portion having the above-mentioned structure, a portion 13*c* which is insufficient in the biaxial orientation and is relatively thin-wall is apt to be deformed by heating. The central portion 13*a* also tends to be thermally deformed, but since having a thick wall, it can withstand the thermal influence to some extent and can prevent the bottom wall 13 from being badly deformed.

However, the portion 13*c* where the orientation is poor is thinner as compared with the central portion

13*a*, therefore when the bottle is filled with contents heated up to a temperature of 75° C. or more, some deformation will be brought about thereon. The portion 13*c* will often be bulged out of the annular edge 14, when loaded.

Such phenomena will impair the self-supporting ability of the bottle, and even if such an impairment is not reached, it is sure that the shape of the bottom will be ugly and its commercial value will be lowered.

As means for providing the portion 13*a*, which includes the poor orientation and will thus easily be thermally affected, with a heat resistance by achieving the sufficient biaxial orientation, there if formed a hollow rib 18 which is shown by a chain line at the intermediate portion of the bottom wall 13.

In most cases, however, such a rib 18 is straight or is somewhat transversely bulged or curved out toward the wall surface of the dome-shape bottom wall 13 owing to the restriction on the blow molding. In short, the rib 18 is not formed so as to noticeably project from the wall surface.

As a result of the formation of such a rib 18 which is slightly bulged or curved out, a bottom area necessary for the biaxial orientation increases only a little. Therefore, the central portion 13*a* in contact with the rib 18 is insufficiently stretched, thereby remaining thick, though the peripheral portion 13*b* in contact therewith is sufficiently done. For this reason, the functional effect of the rib 18 is to improve a heat resistance only for the peripheral portion 13*b* of the bottom wall 13, and the above-mentioned portion 13*c* which is susceptible to a heat influence cannot be provided with the heat resistance. Accordingly, even if the rib 18 is formed, the bottle will be deformed, when packed with heated contents.

SUMMARY OF THE INVENTION

An object of the present invention is to give heat-resisting properties to a bottom wall of a heat-resistant synthetic resin bottle which is still liable to be deformed when filled with heated contents.

Another object of the present invention is to improve, by forming a number of spaced triangular recessed sections having a specific shape in an intermediate portion of the bottom wall which is insufficient in a biaxial orientation, is thinner than a central portion of the bottom wall, and is thus most susceptible to a thermal influence.

Still another object of the present invention is to provide a heat-resistant synthetic resin bottle in which a heat deformation often induced on the bottom wall is prevented by stretching and orienting the central portion of the bottom wall which is liable to be thickly molded, and by providing a number of spaced triangular recessed sections on the intermediate portion of the bottom wall.

The present invention in accordance with the above-mentioned objects is directed to a synthetic resin bottle which is provided with a self-supporting ability and is biaxially oriented by axially stretching and air blowing an injected or extruded closed-end parison in a blow mold to carry out molding, whereby a bottom wall of the bottle is recessed toward its interior in the form of a dome and an annular peripheral edge is formed on the bottom of the bottle, characterized in that a top portion of the bottom wall which is formed gradually thickly from the annular peripheral edge to a central portion thereof is recessed upward from underside of the top portion in order to thin the top portion, and the intermediate portion of the bottom wall is partially reshaped in order to form radially extending triangular pyramid-shaped hollow thin-wall recessed sections which are sufficiently stretched, whereby the intermediate portion of the bottom wall can be prevented from being thermally deformed.

DETAILED DESCRIPTION OF THE INVENTION

Figure 1:
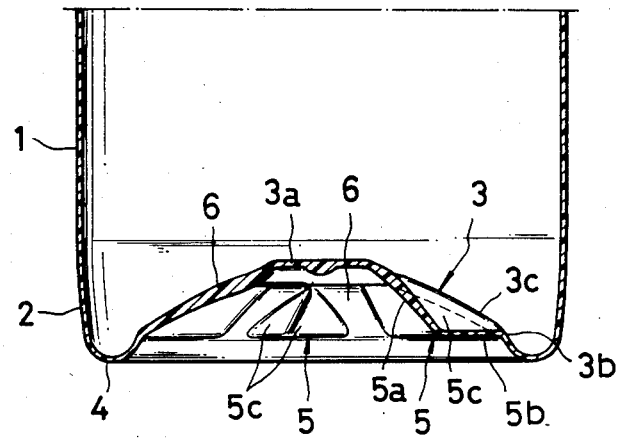
FIG. 1 is a vertical section of the bottom of a heat-resistant synthetic resin bottle according to the present invention.
Figure 2:
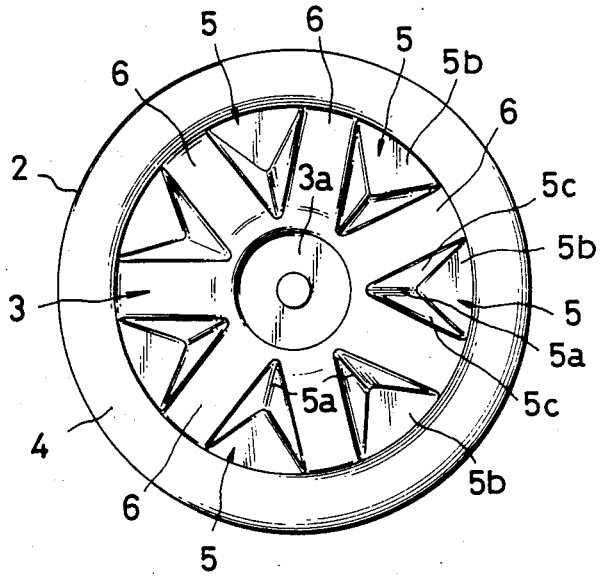
FIG. 2 is a plan of the same bottom as shown in FIG. 1.
Figure 3:
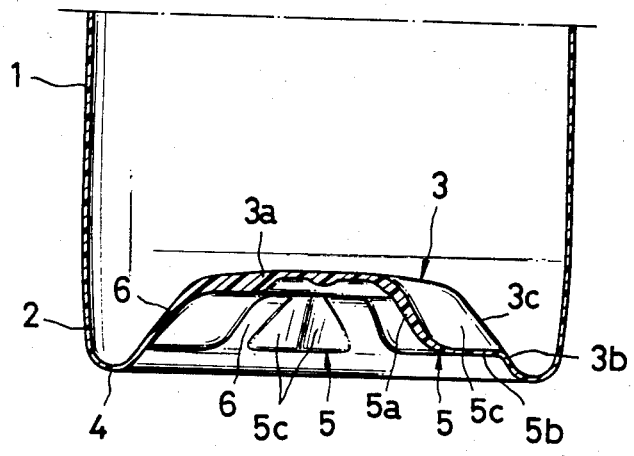
FIG. 3 is a vertical section of the bottom of a bottle of another embodiment according to the present invention.
Figure 4:
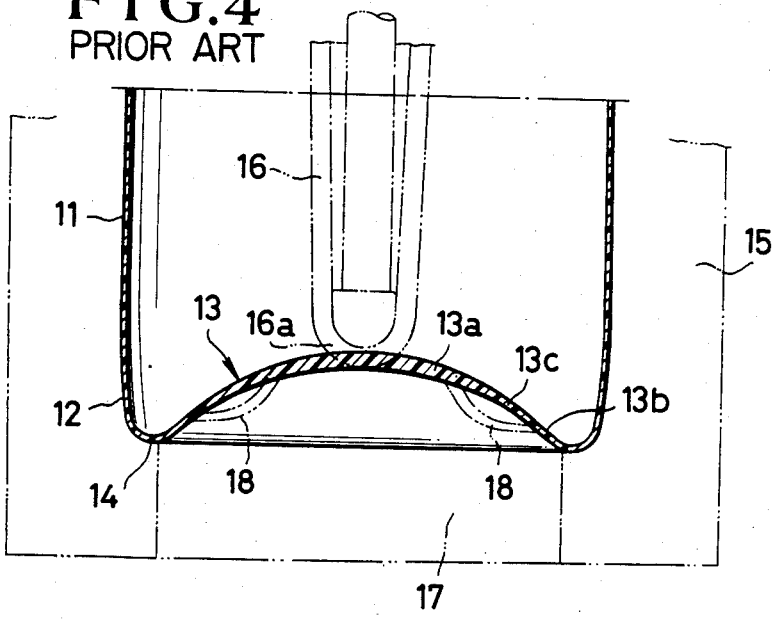
FIG.4 PRIOR ART
FIG. 4 is a vertical section of the bottom of a conventional self-supporting bottle.

In FIGS. 1 to 3, the bottle body 1 is a biaxially oriented unit which has been molded by stretching and blow molding polyethylene terephthalate. The bottom of the bottle body 1 is composed of a sufficiently biaxially oriented peripheral wall 2, a dome-shaped bottom wall 3 which is recessed toward the interior of the bottle and an annular peripheral edge 4 which is a boundary portion between the peripheral wall 2 and the bottom wall 3.

The bottom wall 3 is molded gradually thickly from a connection portion with the annular edge 4 to a central portion thereof, and a top portion 3*a* thereof is thinly molded by recessing upwardly the top portion itself from its lower surface.

In an insufficiently oriented portion 3*c* between the top portion 3*a* and a peripheral portion 3*b* adjacent to the annular peripheral edge 4, there are inwardly and radially disposed triangular pyramid-shaped hollow thin-wall recessed sections 5, 5 formed by partially swelling out the bottom wall portion at constant intervals, and between the respective pairs of the triangular recessed sections 5, 5, there are undeformed lands or connecting elements 6, 6 of the bottom wall 3.

A ridge 5*a* connecting a tip of each recessed section 5 with the top portion 3*a* can be optionally set at an angle within the range of 30° to 90° with respect to a horizontal. When this angle is less than 30°, the bottom area in which the sufficient stretch is attained will be reduced, and thus the effect of improving the portion 3 by the biaxial orientation cannot be expected. In each triangular recessed sections 5, a bottom surface 5*b* is thinly molded similarly to the peripheral portion 3*b*, but a side surface 5*c* of the lug 5 is gradually thick toward the top portion 3*a* together with the ridge portion 5*a*. The number of the triangular recessed sections 5 depends on the magnitude of the bottom area, and in the embodiment shown in the drawings, the five triangular recessed sections 5 serve to improve the bottom wall 3 but six such triangular recessed sections 5 may be provided thereon.

With regard to the bottle having such a bottom structure, all the portions 3*c* other than the bottom lands or connecting elements 6, 6 are biaxially oriented, therefore the portions which will tend to bring about a heat deformation are only the bottom lands or connecting elements 6, 6. However, since these bottom lands or connecting elements 6, 6 lie between the triangular pyramid-shaped recessed sections 5, 5, an occurred heat deformation will be limited only to these local sections and will not spread all over the bottom wall.

Further, although the respective triangular recessed sections 5, 5 are stretched in a thin-wall state, the load of contents in the bottle is supported by the thick-wall lands or connecting elements 6, 6 and both the sides of the triangular recessed sections 5, 5. Therefore, so long as the bottom lands or connecting elements 6, 6 are not broken, the bottom wall 3 will never project outwardly from the annular peripheral edge 4, even if the load is applied to the triangular recessed sections 5, 5.

Furthermore, in the past, when the bottle filled with contents is dropped, it will break at the central portion of the bottom wall 3, because this center portion is thick-wall. In the case of the present invention, however, since the top portion is thinly stretched as described above, the breakage of the bottle at the central portion can be prevented, which fact can lead to an improved drop impact resistance.

FIG. 3 shows another embodiment of the bottle in which the bottom lands or connecting elements 6, 6 are stretched to accomplish the biaxial orientation. In this embodiment, the molding of the triangular recessed sections 5, 5 which are bulged up from the bottom wall to create the recesses at the bottom of the bottom wall can easily be carried out by inwardly recessing the bottom lands or connecting elements 6, 6 of the bottom wall 3.

As understood from the foregoing, according to the present invention, the heat deformation and the load deformation of the bottom wall can be inhibited, and the bottle of the present invention can keep up the self-supporting ability, even if packed with high-temperature contents. Further, since the upwardly curved top portion of the bottom wall and the triangular pyramid-shaped recessed sections can easily be molded by using a blow mold, the increase in costs can be restrained.

What is claimed is:

1. A heat-resistant synthetic resin bottle which is biaxially oriented by axially stretching and air blowing an injected or extruded closed-end parison in a blow mold to carry out molding, whereby a bottom wall of said bottle is recessed toward its interior in the form of a dome and an annular peripheral edge for supporting said bottle itself is formed around said bottom wall, characterized in that a top portion of said bottom wall which is formed gradually thickening from said annular peripheral edge to a central portion thereof and is recessed upwardly from the underside of said top portion itself in order to thin said top portion, and said bottom wall between said top portion and said peripheral edge is partially outwardly additionally curved in order to radially form a predetermined number of triangular pyramid-shaped recessed sections having a pair of connected bottom walls and bottom lands between said recessed sections.

2. The heat-resistant synthetic resin bottle according to claim 1 wherein the bottoms of said triangular pyramid-shaped recessed sections are thin-wall, and the opposite sides of each recessed section is connected along a line forming a ridge between said opposite sides and the sides are gradually thickened toward said ridge.

3. The heat-resistant synthetic resin bottle of claim 2 wherein the said ridge is at an angle in the range of 30° to 90° with respect to a horizontal plane which includes said annular peripheral edge.

* * * * *